US010748500B2

(12) United States Patent
Shan

(10) Patent No.: US 10,748,500 B2
(45) **Date of Patent: *Aug. 18, 2020**

(54) DRIVING APPARATUS AND METHOD OF DISPLAY PANEL

(71) Applicant: HKC CORPORATION LIMITED, Shenzhen, Guangdong (CN)

(72) Inventor: Jianfeng Shan, Guangdong (CN)

(73) Assignee: HKC Corporation Limited, Shenzhen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/070,343

(22) PCT Filed: Jan. 11, 2018

(86) PCT No.: PCT/CN2018/072291

§ 371 (c)(1),
(2) Date: Jul. 16, 2018

(87) PCT Pub. No.: WO2019/080374

PCT Pub. Date: May 2, 2019

(65) Prior Publication Data

US 2019/0333463 A1 Oct. 31, 2019

(30) Foreign Application Priority Data

Oct. 25, 2017 (CN) ..... 2017 1 1018989

(51) Int. Cl.
*G09G 3/36* (2006.01)

(52) U.S. Cl.
CPC ... *G09G 3/3677* (2013.01); *G09G 2310/0205* (2013.01); *G09G 2320/0242* (2013.01)

(58) Field of Classification Search
CPC ..... G09G 3/3266; G09G 2300/0852; G09G 2300/0861; G09G 2300/0814
See application file for complete search history.

(56) References Cited

U.S. PATENT DOCUMENTS

2003/0043104 A1* 3/2003 Lee ..... G11C 19/184 345/92
2007/0229427 A1* 10/2007 Chen ..... G09G 3/3659 345/92
2008/0192038 A1* 8/2008 Liu ..... G09G 3/20 345/206
2009/0027581 A1* 1/2009 You ..... G02F 1/13624 349/48

(Continued)

*Primary Examiner* — Shaheda A Abdin

(57) ABSTRACT

The present application discloses a driving apparatus and method of a display panel. The apparatus includes a first driver circuit and a second driver circuit; each of the first driver circuit includes two first sub driver circuits, the two first sub driver circuits correspondingly connected to one first scan line and oppositely arranged on two ends of the first scan line, and the two first sub driver circuits jointly driving the first scan line; each of the second driver circuit includes two second sub driver circuits, the two second sub driver circuits correspondingly connected to one second scan line and oppositely arranged on two ends of the second scan line, and the two second sub driver circuits jointly driving the second scan line; and the two second sub driver circuits oppositely arranged on the two ends of the second scan line jointly drive the second scan line.

20 Claims, 3 Drawing Sheets

(56) References Cited

U.S. PATENT DOCUMENTS

2009/0046041 A1* 2/2009 Tanikame ..... H01L 27/124
345/76
2009/0135323 A1* 5/2009 Yang ..... G02F 1/13624
349/37
2011/0148825 A1* 6/2011 Ueno ..... G09G 3/006
345/204
2012/0033148 A1* 2/2012 Yang ..... G02F 1/134309
349/39
2014/0372494 A1* 12/2014 Lin ..... G06F 5/08
708/209
2015/0294636 A1* 10/2015 Yu ..... G09G 3/3655
345/204
2016/0140927 A1* 5/2016 Maruyama ..... G09G 3/2007
345/89

* cited by examiner

DRIVING APPARATUS AND METHOD OF DISPLAY PANEL

TECHNICAL FIELD

The present application relates to the display panel field, and in particular, to a driving apparatus and method of a display panel.

BACKGROUND

At present, when a user views a vertical alignment type liquid crystal display panel from the side, especially a large-size liquid crystal display panel, color shift occurs, and the color shift increases along with an increased viewing angle from the side. To reduce the color shift and increase a viewing angle range, each pixel unit of a display area of a liquid crystal display panel is usually divided into a sub pixel and a main pixel, so that a potential difference is present between the sub pixel and the main pixel, and a tilt angle of liquid crystal inside the liquid crystal display panel changes, thereby achieving an effect of reducing the color shift. However, when the color shift is reduced, a scan line that enables a potential difference to be present between a sub pixel and a main pixel in the display panel has a high load.

SUMMARY

A main purpose of the present application is to provide a driving apparatus and method of a display panel to solve a problem that when the color shift is reduced, a scan line that controls a potential difference to be present between a sub pixel and a main pixel has a high load.

To achieve the above purpose, the present application provides a driving apparatus of a display panel, where the display panel includes a pixel region including a pixel unit array, each of pixel units includes a main pixel and a sub pixel, and the driving apparatus of the display panel includes:

an active switch array, including a main driver thin film transistor arranged opposite to the main pixel, a sub driver thin film transistor arranged opposite to the sub pixel, and a charge-sharing thin film transistor arranged opposite to the sub pixel;

a scan line array, including a first scan line and a second scan line, where the first scan line is configured to drive the main driver thin film transistor and the sub driver thin film transistor, and the second scan line is configured to drive the charge-sharing thin film transistor; and a gate driver on array circuit, including a first driver circuit and a second driver circuit, where each of the first driver circuit includes:

two first sub driver circuits, where the two first sub driver circuits are correspondingly connected to one of the first scan line and oppositely arranged on two ends of the first scan line, and the two first sub driver circuits jointly drive the first scan line;

each of the second driver circuit includes:

two second sub driver circuits, where the two second sub driver circuits are correspondingly connected to one of the second scan line and oppositely arranged on two ends of the second scan line, and the two second sub driver circuits jointly drive the second scan line; and the two second sub driver circuits oppositely arranged on the two ends of the second scan line jointly drive the second scan line, so that a potential difference is present between the main pixel and the sub pixel of each of the pixel units after the two first sub driver circuits jointly drive the first scan line.

Optionally, the two first sub driver circuits jointly drive the first scan line to be ON or OFF, so as to control the main driver thin film transistor and the sub driver thin film transistor to be turned on or turned off.

Optionally, the gate of the main driver thin film transistor and the gate of the sub driver thin film transistor are separately connected to the first scan line; the source of the main driver thin film transistor and the source of the sub driver thin film transistor are charge input ends of the pixel units; and the drain of the main driver thin film transistor is a charge storage end of the main pixel, and the drain of the sub driver thin film transistor is a charge storage end of the sub pixel.

Optionally, the gate of the charge-sharing thin film transistor is connected to the second scan line, the source of the charge-sharing thin film transistor is connected to the charge storage end of the sub pixel, and the drain of the charge-sharing thin film transistor is a shared charge storage end of the sub pixel.

Optionally, the gate of the main driver thin film transistor and the gate of the sub driver thin film transistor are separately connected to the first scan line; the drain of the main driver thin film transistor and the drain of the sub driver thin film transistor are charge input ends of the pixel units; and the source of the main driver thin film transistor is a charge storage end of the main pixel, and the source of the sub driver thin film transistor is a charge storage end of the sub pixel.

Optionally, the gate of the charge-sharing thin film transistor is connected to the second scan line, the drain of the charge-sharing thin film transistor is connected to the charge storage end of the sub pixel, and the source of the charge-sharing thin film transistor is the shared charge storage end of the sub pixel.

Optionally, the first driver circuit and the second driver circuit are arranged at an interval.

Optionally, the quantity of the first driver circuits is equal to that of the second driver circuits.

In addition, to achieve the above purpose, the present application further provides a driving method of a display panel, where the display panel includes a gate driver on array circuit; the gate driver on array circuit includes a first driver circuit and a second driver circuit; each of the first driver circuit includes two first sub driver circuits, and the two first sub driver circuits are oppositely arranged on two sides of a scan line array of the display panel, and jointly drive one first scan line in the scan line array; each of the second driver circuit includes two second sub driver circuits, and the two second sub driver circuits are oppositely arranged on the two sides of the scan line array of the display panel, and jointly drive one second scan line in the scan line array; and the following step is included:

enabling, according to a screen input signal, the two first sub driver circuits in the first driver circuit and the two second sub driver circuits in the second driver circuit to operate based on operation rules at regular intervals, where an operation rule of the two first sub driver circuits is to jointly drive the first scan line in the scan line array according to the screen input signal, so that a main driver thin film transistor and a sub driver thin film transistor that are connected to the first scan line are turned on; and an operation rule of the two second sub driver circuits is to jointly drive the second scan line in the scan line array according to the screen input signal, so that a charge-sharing thin film transistor connected to the second scan line is turned on.

In addition, to achieve the above purpose, the present application further provides a driving apparatus of a display panel, where the display panel includes a pixel region including a pixel unit array, each of pixel units includes a main pixel and a sub pixel, and the driving apparatus of the display panel includes:

an active switch array, including a main driver thin film transistor arranged opposite to the main pixel, a sub driver thin film transistor arranged opposite to the sub pixel, and a charge-sharing thin film transistor arranged opposite to the sub pixel;

a scan line array, including a first scan line and a second scan line, where the first scan line is configured to drive the main driver thin film transistor and the sub driver thin film transistor, and the second scan line is configured to drive the charge-sharing thin film transistor; and a gate driver on array circuit, including a first driver circuit and a second driver circuit, where the first driver circuit and the second driver circuit are arranged in parallel at an interval; where each of the first driver circuit includes:

two first sub driver circuits, where the two first sub driver circuits are correspondingly connected to one of the first scan line and oppositely arranged on two ends of the first scan line, and the two first sub driver circuits jointly drive the first scan line;

each of the second driver circuit includes:

two second sub driver circuits, where the two second sub driver circuits are correspondingly connected to one of the second scan line and oppositely arranged on two ends of the second scan line, and the two second sub driver circuits jointly drive the second scan line; and the two second sub driver circuits oppositely arranged on the two ends of the second scan line jointly drive the second scan line, so that a potential difference is present between the main pixel and the sub pixel of each of the pixel units after the two first sub driver circuits jointly drive the first scan line.

According to the technical solutions of the present application, each of the first driver circuit in the driving apparatus of the display panel includes two first sub driver circuits, where the two first sub driver circuits are correspondingly connected to one first scan line and oppositely arranged on two ends of the first scan line, and the two first sub driver circuits jointly drive the first scan line; each of the second driver circuit includes two second sub driver circuits, where the two second sub driver circuits are correspondingly connected to one second scan line and oppositely arranged on two ends of the second scan line, and the two second sub driver circuits jointly drive the second scan line. Since the two first sub driver circuits of each of the first driver circuit and the two second sub driver circuits of each of the second driver circuit are independent of each other, and can simultaneously drive different types of scan lines to operate, so that the first scan line and the second scan line do not interfere with each other and are independent of each other in function, thereby balancing a load of each scan line in the scan line array and reducing a load of a single scan line that controls a potential difference to be present between a sub pixel and a main pixel.

BRIEF DESCRIPTION OF DRAWINGS

To describe the technical solutions in the embodiments of the present application or in the prior art more clearly, the following briefly describes the accompanying drawings required for describing the embodiments or the prior art. Apparently, the accompanying drawings in the following description are some embodiments of the present application, and a person of ordinary skill in the art may still derive other drawings from structures shown in these accompanying drawings without creative efforts.

Figure 1:
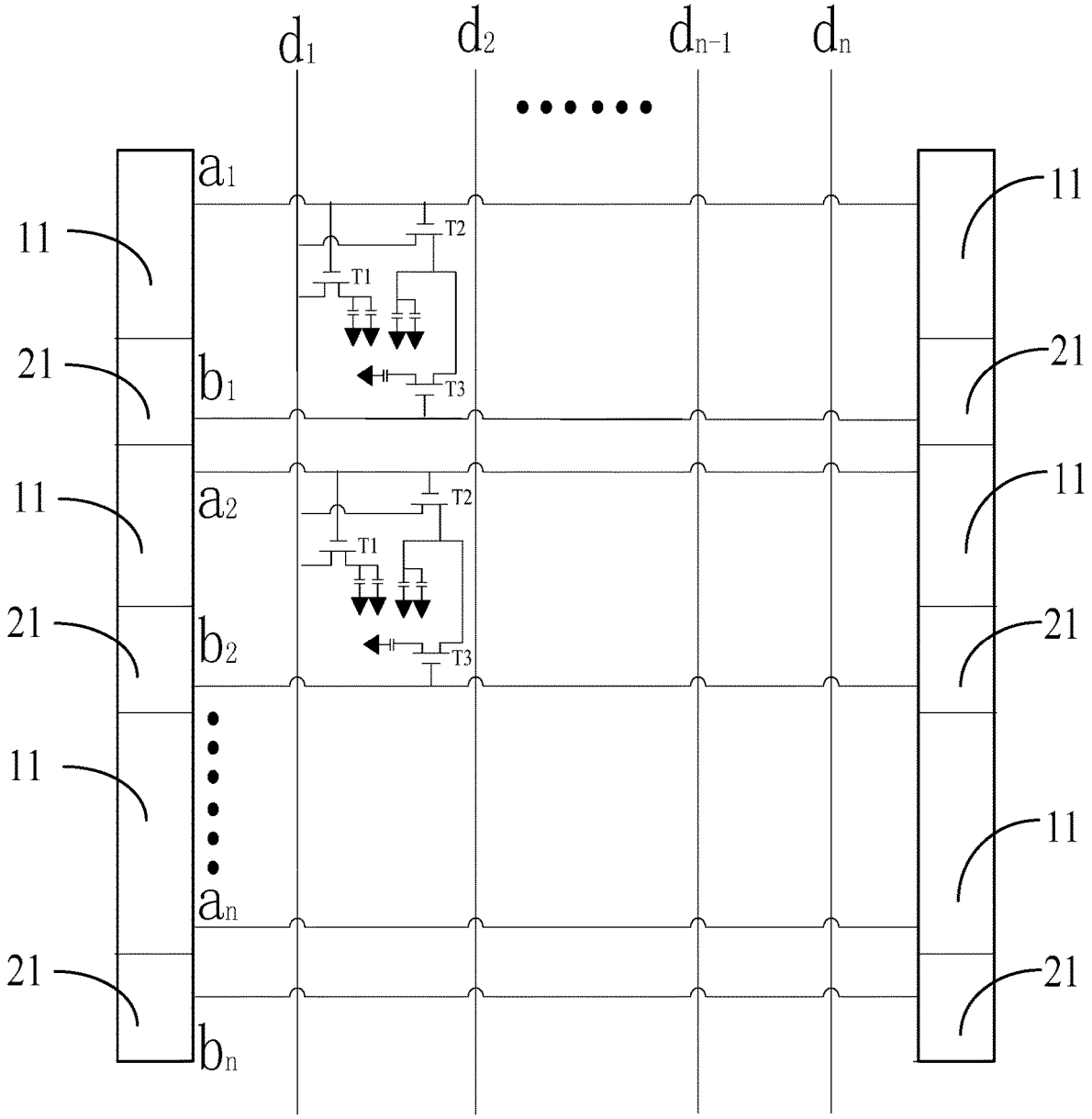
FIG. 1 is a structural block diagram of a driving apparatus of a display panel in an embodiment of the present application.

The implementation of the purpose, functional features, and advantages of the present application will be further described in conjunction with the embodiments and the accompanying drawings.

DETAILED DESCRIPTION

It should be understood that the embodiments described herein are merely used to explain the present application, rather than to limit the present application.

The following clearly and completely describes the technical solutions in the embodiments of the present application with reference to the accompanying drawings in the embodiments of the present application. Apparently, the described embodiments are merely a part rather than all of the embodiments of the present application. All other embodiments obtained by a person of ordinary skill in the art based on the embodiments of the present application without creative efforts shall fall within the protection scope of the present application.

It should be noted that all the directional indications (such as "upper", "lower", "left", "right", "front", "rear", etc.) in the embodiments of the present application are merely used to explain a relative position relationship, motion situations, and the like of the components in a specific gesture (as shown in the figures). If the specific gesture changes, the directivity indication also changes accordingly.

Moreover, the terms such as "first", "second", and the like described in the present application are used herein only for the purpose of description and are not intended to indicate or imply relative importance, or implicitly indicate the quantity of the indicated technical features. Therefore, features defined by "first" and "second" may explicitly or implicitly include at least one of the features. Furthermore, the technical solutions between the various embodiments may be combined with each other, but must be on the basis that the combination thereof can be implemented by a person of ordinary skill in the art. In case of a contradiction with the combination of the technical solutions or a failure to implement the combination, it should be considered that the combination of the technical solutions does not exist, and is not within the protection scope of the present application.

The present application provides a driving apparatus of a display panel, where the display panel includes a pixel region including a pixel unit array, each of pixel units includes a main pixel and a sub pixel. In the present technical solution, differentiating the main pixel and the sub pixel is mainly applicable to a design scheme of low color shift for the purpose of reducing color shift.

It should be noted that a scan line of a scan line array in a prior driving apparatus of a display panel is divided into a gate line and a sharing line, and each of the scan line is driven by a gate driver on array (GOA) circuit. A process in which the gate line and the sharing line drive a thin film transistor (TFT) array to reduce color shift is: in pixel units of row A that are surrounded by a gate line B and a sharing line C, the GOA circuit controls the gate line B to be turned on, so that the pixel units of row A are filled with charge; after the gate line B is turned off, the sharing line C is turned on, and then the GOA circuit controls to generate a potential difference in the pixel units of row A; and after the sharing line C controls to generate a potential difference in the pixel units of row A, the sharing line C is used as a gate line of pixel units of row A+1, and the GOA circuit controls the pixel units of row A+1 to be filled with charge, and so forth. The sharing line in the above solution may be understood as a common line, that is, the GOA circuit needs to implement two different functions when driving the sharing line. Therefore, a scan line that controls a potential difference to be present between the driver TFTs has a high load.

Referring to FIG. 1, in an embodiment of the present application, the driving apparatus of the display panel includes:

an active switch array (not shown), including a main driver TFT (T1) arranged opposite to the main pixel, a sub driver TFT (T2) arranged opposite to the sub pixel, and a charge-sharing TFT (T3) arranged opposite to the sub pixel;

a scan line array (not shown), including a first scan line $a_n$(n=1, 2, . . . , n) and a second scan line $b_n$(n=1, 2, . . . , n), where the first scan line $a_n$(n=1, 2, . . . , n) is configured to drive the main driver TFT (T1) and the sub driver TFT (T2), and the second scan line $b_n$(n=1, 2, . . . , n) is configured to drive the charge-sharing TFT (T3); and a GOA circuit (not shown), including a first driver circuit (not shown) and a second driver circuit (not shown), where each of the first driver circuit includes:

two first sub driver circuits 11, where the two first sub driver circuits 11 are correspondingly connected to one of the first scan line $a_n$(n=1, 2, . . . , n) and oppositely arranged on two ends of the first scan line $a_n$(n=1, 2, . . . , n), and the two first sub driver circuits 11 jointly drive the first scan line $a_n$(n=1, 2, . . . , n);

each of the second driver circuit includes:

two second sub driver circuits 21, where the two second sub driver circuits 21 are correspondingly connected to one of the second scan line $b_n$(n=1, 2, . . . , n), and oppositely arranged on two ends of the second scan line $b_n$(n=1, 2, . . . , n), and the two second sub driver circuits 21 jointly drive the second scan line $b_n$(n=1, 2, . . . , n); and the two second sub driver circuits 21 oppositely arranged on the two ends of the second scan line $b_n$(n=1, 2, . . . , n) jointly drive the second scan line $b_n$(n=1, 2, . . . , n), so that a potential difference is present between the main pixel and the sub pixel of each of the pixel units after the two first sub driver circuits 11 jointly drive the first scan line $a_n$(n=1, 2, . . . , n).

Optionally, the above active switch array may be a thin film transistor array, and the above scan line array may be a row scan line array. The above first scan line $a_n$(n=1, 2, . . . , n) may also be parallel with the above second scan line $b_n$ (n=1, 2, . . . , n), and the two scan lines are arranged at an interval. This arrangement complies with the scan line array arrangement, ensuring the maximum number of pixel units.

With reference to the above structure, in another embodiment, for example, the driving apparatus of the display panel may include:

an active switch array, including a main driver TFT (T1) arranged opposite to the main pixel, a sub driver TFT (T2) arranged opposite to the sub pixel, and a charge-sharing TFT (T3) arranged opposite to the sub pixel;

a scan line array, including a first scan line $a_n$(n=1, 2, . . . , n) and a second scan line $b_n$(n=1, 2, . . . , n), where the first scan line $a_n$(n=1, 2, . . . , n) is configured to drive the main driver TFT (T1) and the sub driver TFT (T2), and the second scan line $b_n$(n=1, 2, . . . , n) is configured to drive the charge-sharing TFT (T3); and a GOA circuit, including a first driver circuit 10 and a second driver circuit 20, where the first driver circuit 10 and the second driver circuit 20 are parallel and arranged at an interval, where each of the first driver circuit 10 includes:

two first sub driver circuits 11, where the two first sub driver circuits 11 are correspondingly connected to one of the first scan line $a_n$(n=1, 2, . . . , n) and oppositely arranged on two ends of the first scan line $a_n$(n=1, 2, . . . , n), and the two first sub driver circuits 11 jointly drive the first scan line $a_n$(n=1, 2, . . . , n);

each of the second driver circuit 20 includes:

two second sub driver circuits 21, where the two second sub driver circuits 21 are correspondingly connected to one of the second scan line $b_n$(n=1, 2, . . . , n) and oppositely arranged on two ends of the second scan line $b_n$(n=1, 2, . . . , n), and the two second sub driver circuits 21 jointly drive the second scan line $b_n$(n=1, 2, . . . , n); and the two second sub driver circuits 21 oppositely arranged on the two ends of the second scan line $b_n$(n=1, 2, . . . , n) jointly drive the second scan line $b_n$(n=1, 2, . . . , n), so that a potential difference is present between the main pixel and the sub pixel of each of the pixel units after the two first sub driver circuits 11 jointly drive the first scan line $a_n$(n=1, 2, . . . , n).

The two first sub driver circuits 11 in each of the first driver circuits in the driving apparatus of the display panel jointly control one scan line, and the two second sub driver circuits 21 in each of second driver circuits jointly control one scan line, thereby forming a bilateral drive. It should be noted that the scan line controlled by the two first sub driver circuits 11 is different from the scan line controlled by the two second sub driver circuits 21. The scan line may include the first scan line $a_n$(n=1, 2, . . . , n) and the second scan line $b_n$(n=1, 2, . . . , n). Alternatively, the two first sub driver circuits 11 may jointly drive the first scan line $a_n$(n=1, 2, . . . , n), and the two second sub driver circuits 21 separately drive the second scan line $b_n$(n=1, 2, . . . , n).

For example, an execution process of reducing color shift by the driving apparatus of the display panel may be: when the two first sub driver circuits 11 drive the first scan line $a_n$(n=1, 2, . . . , n), pixel units corresponding to the sub driver TFT (T2) and the main driver TFT (T1) are filled with charge; the two second sub driver circuits 21 jointly drive the second scan line $b_n$(n=1, 2, . . . , n) to enable the charge-sharing TFT to be turned on, and partial charge in the sub pixel is lost, so that a potential difference is present between the sub pixel corresponding to the sub driver TFT (T2) and the main pixel corresponding to the main driver TFT (T1), and a tilt angle is generated in the liquid crystal inside the liquid crystal layer of the display panel due to the potential difference, thereby achieving the effect of reducing color shift. Since the two first sub driver circuits 11 and the two second sub driver circuits 21 control the first scan line $a_n$(n=1, 2, . . . , n) and the second scan line $b_n$(n=1, 2, . . . , n) respectively, an original sharing line is divided into two lines, and two sub driver circuits corresponding to each of the scan line jointly drive to control pixel units of a certain line to be filled with charge, or control a potential difference to be present between the sub pixel and the main pixel in the pixel units, so as to reduce a load of a single scan line.

Figure 2:
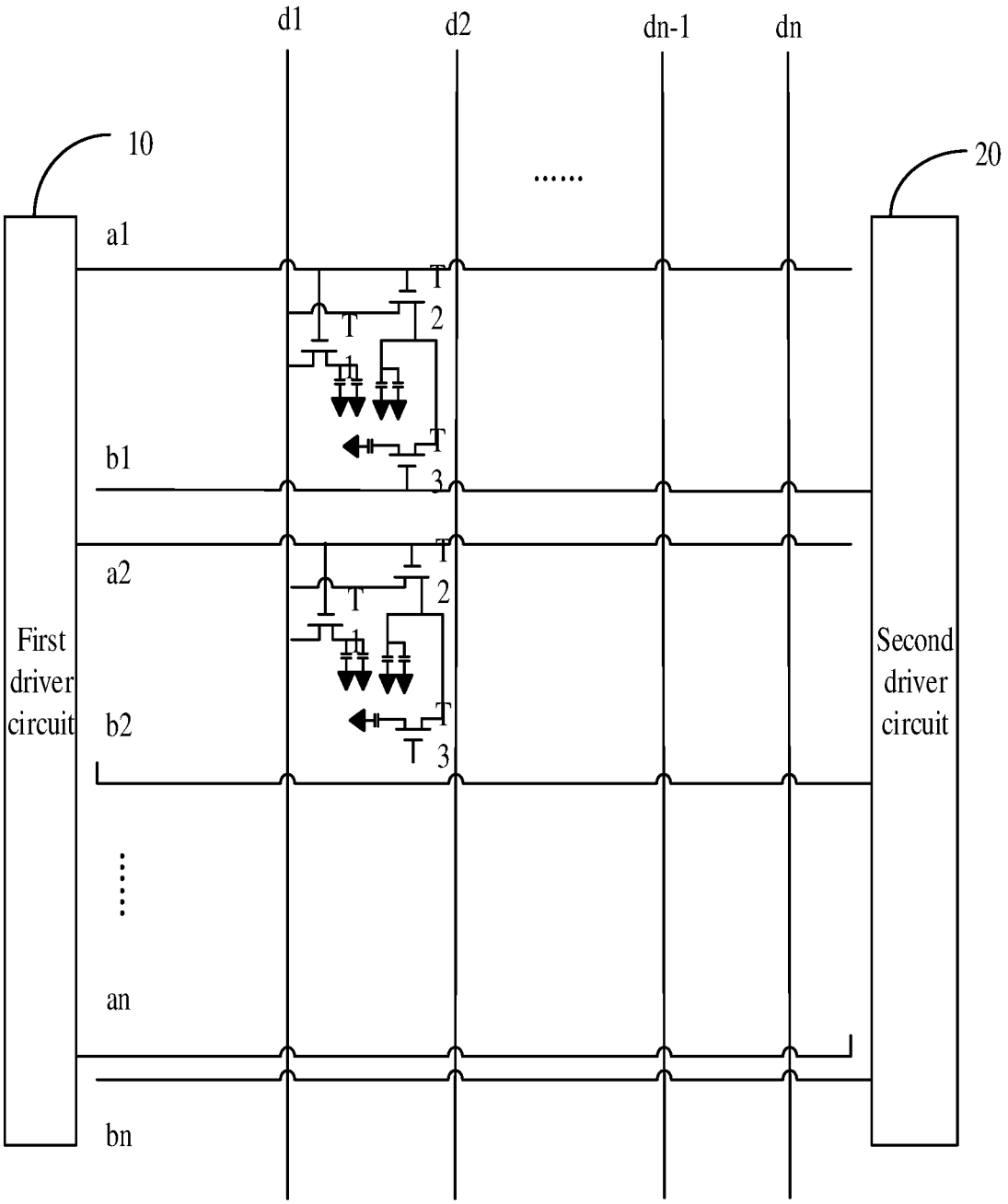
FIG. 2 is a structural block diagram of a driving apparatus of a display panel in another embodiment of the present application.

Referring to FIG. 2, in another embodiment, the first driver circuit 10 and the second driver circuit 20 are oppositely arranged on two sides of the scan line array, the first driver circuit 10 is correspondingly connected to multiple first scan lines $a_n$(n=1, 2, . . . , n), and the second driver circuit 20 is correspondingly connected to multiple second scan lines $b_n$(n=1, 2, . . . , n).

Figure 3:
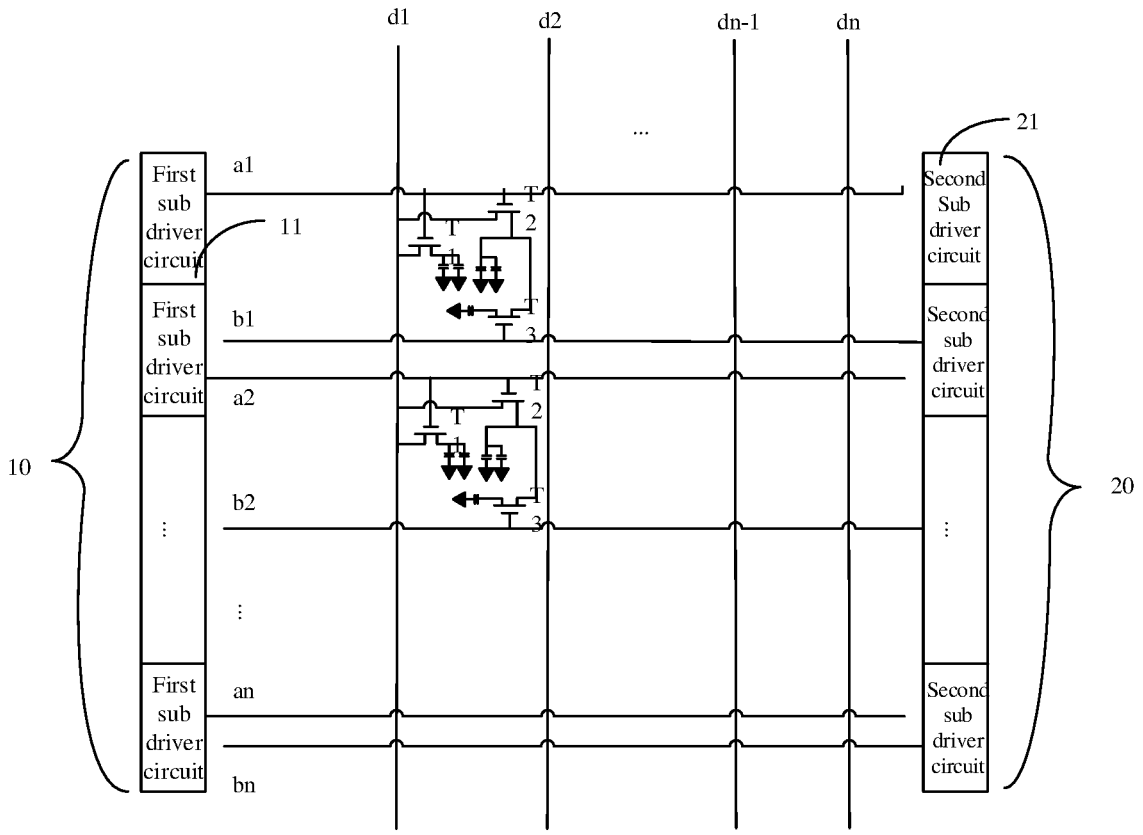
FIG. 3 is a structural block diagram of a driving apparatus of a display panel in another embodiment of the present application.

Referring to FIG. 3 again, in yet another embodiment, the first driver circuit 10 and the second driver circuit 20 may be oppositely arranged on two sides of the scan line array, the first driver circuit 10 is correspondingly connected to multiple first scan lines $a_n$(n=1, 2, . . . , n) lines, and the second driver circuit 20 is correspondingly connected to multiple second scan lines $b_n$(n=1, 2, . . . , n). The first driver circuit 10 includes multiple first sub driver circuits 11, and each of the first sub driver circuits 11 is correspondingly connected to one of the first scan lines $a_n$(n=1, 2, . . . , n); the second driver circuit 20 includes multiple second sub driver circuits 21, and each of the second driver circuits 20 is correspondingly connected to one of the second scan lines $b_n$(n=1, 2, . . . , n), thereby forming a unilateral drive.

In the above embodiment, the first driver circuit 10 and the second driver circuit 20, or the first sub driver circuit 11 and the second sub driver circuit 21 are arranged on two sides of the scan line array, so that imaging of the display panel is not affected, it is convenient for the GOA circuit to control the scan line array, and the layout is more compact. In addition, when the first scan line $a_n$(n=1, 2, . . . , n) and the second scan line $b_n$(n=1, 2, . . . , n) in the scan line array are arranged in parallel, it is convenient to align with the arrangement of the scan line array.

Referring to FIG. 1 again, it should be noted that, that the two first sub driver circuits 11 jointly drive the first scan line $a_n$(n=1, 2, . . . , n) may be that, for example, the two first sub driver circuits 11 jointly drive the first scan line $a_n$(n=1, 2, . . . , n) to be turned on or turned off, so as to control the main driver TFT (T1) and the sub driver TFT (T2) to be turned on or turned off. By controlling the main driver TFT (T1) and the sub driver TFT (T2) to be turned on, the main driver TFT (T1) and the sub driver TFT (T2) may perform the operation of being filled with charge.

Optionally, to enable a potential difference to be present between all the sub pixels and main pixels in the pixel region of the liquid crystal display panel by the driving apparatus of the display panel, the quantity of the first scan lines $a_n$(n=1, 2, . . . , n) may be set to be equal to that of the second scan line $b_n$(n=1, 2, . . . , n).

Optionally, in the driving apparatus of the display panel, a circuit connection structure of the active switch array may be: the gate of the main driver TFT (T1) and the gate of the sub driver TFT (T2) are separately connected to the first scan line $a_n$(n=1, 2, . . . , n); the source of the main driver TFT (T1) and the source of the sub driver TFT (T2) are charge input ends of the pixel units; and the drain of the main driver TFT (T1) is a charge storage end of the main pixel, and the drain of the sub driver TFT (T2) is a charge storage end of the sub pixel. The gate of the charge-sharing TFT (T3) is connected to the second scan line $b_n$(n=1, 2, . . . , n); the source of the charge-sharing TFT (T3) is connected to the charge storage end of the sub pixel; and the drain of the charge-sharing TFT (T3) is a shared charge storage end of the sub pixel. The shared charge storage end is configured to store partial charge of the charge storage end of the sub pixel, so that a potential difference is present between the sub pixel corresponding to the sub driver TFT (T2) and the main pixel corresponding to the main driver TFT (T1).

It should be noted that the connection manners of the sources and drains of the main driver TFT (T1), the sub driver TFT (T2), and the charge-sharing TFT (T3) may be exchanged with each other. For example, the circuit structure may be: the gate of the main driver TFT (T1) and the gate of the sub driver TFT (T2) are separately connected to the first scan line $a_n$(n=1, 2, . . . , n); the drain of the main driver TFT (T1) and the drain of the sub driver TFT (T2) are charge input ends of the pixel units; and the source of the main driver TFT (T1) is a charge storage end of the main pixel, and the source of the sub driver TFT (T2) is a charge storage end of the sub pixel. The gate of the charge-sharing TFT (T3) is connected to the second scan line $b_n$(n=1, 2, . . . , n); the drain of the charge-sharing TFT (T3) is connected to the charge storage end of the sub pixel; and the source of the charge-sharing TFT (T3) is the shared charge storage end of the sub pixel.

When the two first sub driver circuits 11 jointly drive the first scan line $a_n$(n=1, 2, . . . , n), the gates of the driver TFTs corresponding to the main pixel and the sub pixel are turned on, charge is inputted into the charge input end of the main pixel and the charge input end of the sub pixel, and the charge is stored at the charge storage end of the main pixel and the charge storage end of the sub pixel. When the two second sub driver circuits 21 jointly drive the second scan line $b_n$(n=1, 2, . . . , n), the gate of the charge-sharing TFT (T3) of the sub pixel is turned on, charge stored at the charge storage end of the sub pixel flows to the shared charge storage end of the sub pixel, so that a potential difference is present between the sub pixel and the main pixel, and a tilt angle of liquid crystal deflects. The circuit layout of the main driver TFT (1), the sub driver TFT (T2), and the charge-sharing TFT (T3) provides a complete hardware structure for the low color shift design of the driving apparatus of the display panel.

The present application further provides a driving method of a display panel, where the display panel includes a gate driver on array circuit; the gate driver on array circuit includes a first driver circuit and a second driver circuit; each of the first driver circuit includes two first sub driver circuits, and the two first sub driver circuits are oppositely arranged on two sides of a scan line array of the display panel, and jointly drive one first scan line in the scan line array; each of the second driver circuit includes two second sub driver circuits, and the two second sub driver circuits are oppositely arranged on the two sides of the scan line array of the display panel, and jointly drive one second scan line in the scan line array; and the following step is included:

enabling, according to a screen input signal, the two first sub driver circuits in the first driver circuit and the two second sub driver circuits in the second driver circuit to operate based on operation rules at regular intervals, where an operation rule of the two first sub driver circuits is to jointly drive the first scan line in the scan line array according to the screen input signal, so that a main driver thin film transistor and a sub driver thin film transistor that are connected to the first scan line are turned on; and an operation rule of the two second sub driver circuits is to jointly drive the second scan line in the scan line array according to the screen input signal, so that a charge-sharing thin film transistor connected to the second scan line is turned on.

The driving method of the display panel is a driving process corresponding to the driving apparatus of the display panel described above; therefore, the driving method of the display panel has all the beneficial effects of the driving apparatus of the display panel described above.

The foregoing is merely an alternative embodiment of the present application and does not constitute a limitation on the scope of the present patent application. Any equivalent structure or equivalent process change made by using the description and the accompanying drawings of the present application, or direct or indirect application thereof in other related technical fields shall still fall in the protection scope of the patent of this application.

What is claimed is:

1. A driving apparatus of a display panel, wherein the display panel comprises a pixel region comprising a pixel unit array, each of pixel units comprises a main pixel and a sub pixel, and the driving apparatus of the display panel comprises:

active switch arrays, each active switch array comprising a main driver thin film transistor arranged opposite to the main pixel, a sub driver thin film transistor arranged opposite to the sub pixel, and a charge-sharing thin film transistor arranged opposite to the sub pixel;

scan line arrays, each scan line array comprising a first scan line and a second scan line, wherein the first scan line is configured to drive the main driver thin film transistor and the sub driver thin film transistor, and the second scan line is configured to drive the charge-sharing thin film transistor, each scan line array being spaced apart and separated from each other; and gate drivers on array circuit, each gate driver on array circuit comprising a first driver circuit and a second driver circuit, wherein each of the first driver circuit comprises:

two first sub driver circuits, wherein the two first sub driver circuits are correspondingly connected to one of the first scan line and oppositely arranged on two ends of the first scan line, and the two first sub driver circuits jointly drive the first scan line;

each of the second driver circuit comprises:

two second sub driver circuits, wherein the two second sub driver circuits are correspondingly connected to one of the second scan line and oppositely arranged on two ends of the second scan line, and the two second sub driver circuits jointly drive the second scan line; and the two second sub driver circuits oppositely arranged on the two ends of the second scan line jointly drive the second scan line, so that a potential difference is present between the main pixel and the sub pixel of each of the pixel units after the two first sub driver circuits jointly drive the first scan line.

2. The driving apparatus of the display panel of claim 1, wherein the first driver circuit and the second driver circuit are arranged at an interval.

3. The driving apparatus of the display panel of claim 2, wherein the quantity of the first driver circuits is equal to that of the second driver circuits.

4. The driving apparatus of the display panel of claim 1, wherein the two first sub driver circuits jointly drive the first scan line to be ON or OFF, so as to control the main driver thin film transistor and the sub driver thin film transistor to be turned on or turned off.

5. The driving apparatus of the display panel of claim 4, wherein the first driver circuit and the second driver circuit are arranged at an interval.

6. The driving apparatus of the display panel of claim 5, wherein the quantity of the first driver circuits is equal to that of the second driver circuits.

7. The driving apparatus of the display panel of claim 4, wherein the gate of the main driver thin film transistor and the gate of the sub driver thin film transistor are separately connected to the first scan line; the source of the main driver thin film transistor and the source of the sub driver thin film transistor are charge input ends of the pixel units; and the drain of the main driver thin film transistor is a charge storage end of the main pixel, and the drain of the sub driver thin film transistor is a charge storage end of the sub pixel.

8. The driving apparatus of the display panel of claim 7, wherein the gate of the charge-sharing thin film transistor is connected to the second scan line, the source of the charge-sharing thin film transistor is connected to the charge storage end of the sub pixel, and the drain of the charge-sharing thin film transistor is a shared charge storage end of the sub pixel.

9. The driving apparatus of the display panel of claim 4, wherein the gate of the main driver thin film transistor and the gate of the sub driver thin film transistor are separately connected to the first scan line; the drain of the main driver thin film transistor and the drain of the sub driver thin film transistor are charge input ends of the pixel units; and the source of the main driver thin film transistor is a charge storage end of the main pixel, and the source of the sub driver thin film transistor is a charge storage end of the sub pixel.

10. The driving apparatus of the display panel of claim 9, wherein the gate of the charge-sharing thin film transistor is connected to the second scan line, the drain of the charge-sharing thin film transistor is connected to the charge storage end of the sub pixel, and the source of the charge-sharing thin film transistor is a shared charge storage end of the sub pixel.

11. A driving method of a display panel, applied to a driving apparatus of the display panel, wherein the driving apparatus of the display panel comprises:

active switch arrays, each active switch array comprising a main driver thin film transistor arranged opposite to the main pixel, a sub driver thin film transistor arranged opposite to the sub pixel, and a charge-sharing thin film transistor arranged opposite to the sub pixel:

scan line arrays, each scan line array comprising a first scan line and a second scan line, wherein the first scan line is configured to drive the main driver thin film transistor and the sub driver thin film transistor, and the second scan line is configured to drive the charge-sharing thin film transistor, each scan line array being spaced apart and separated from each other; and gate drivers on array circuit; each gate driver on array circuit comprises a first driver circuit and a second driver circuit; each first driver circuit comprises two first sub driver circuits, and the two first sub driver circuits are oppositely arranged on two sides of each scan line array of the display panel, and jointly drive one first scan line in each scan line array; each second driver circuit comprises two second sub driver circuits, and the two second sub driver circuits are oppositely arranged on the two sides of each scan line array of the display panel, and jointly drive one second scan line in each scan line array; and the following step is comprised:

enabling, according to a screen input signal, the two first sub driver circuits in the first driver circuit and the two second sub driver circuits in the second driver circuit to operate based on operation rules at regular intervals, wherein, an operation rule of the two first sub driver circuits is to jointly drive the first scan line in the scan line array according to the screen input signal, so that the main driver thin film transistor and the sub driver thin film transistor that are connected to the first scan line are turned on; and an operation rule of the two second sub driver circuits is to jointly drive the second scan line in the scan line array according to the screen input signal, so that the charge-sharing thin film transistor connected to the second scan line is turned on.

12. The driving method of the display panel of claim 11, wherein the two first sub driver circuits jointly drive the first scan line to be ON or OFF, so as to control the main driver thin film transistor and the sub driver thin film transistor to be turned on or turned off; and the two second sub driver circuits jointly drive the second scan line to be ON or OFF, so as to control the charge-sharing thin film transistor to be turned on or turned off, wherein the two second sub driver circuits oppositely arranged on two ends of the second scan line jointly drive the second scan line, so that a potential difference is present between a main pixel and a sub pixel of each of pixel units after the two first sub driver circuits jointly drive the first scan line.

13. The driving method of the display panel of claim 12, wherein the quantity of the first driver circuits is equal to that of the second driver circuits.

14. A driving apparatus of a display panel, wherein the display panel comprises a pixel region comprising a pixel unit array, each of pixel units comprises a main pixel and a sub pixel, and the driving apparatus of the display panel comprises:

active switch arrays, each active switch array comprising a main driver thin film transistor arranged opposite to the main pixel, a sub driver thin film transistor arranged opposite to the sub pixel, and a charge-sharing thin film transistor arranged opposite to the sub pixel;

scan line arrays, each scan line array comprising a first scan line and a second scan line, wherein the first scan line is configured to drive the main driver thin film transistor and the sub driver thin film transistor; the second scan line is configured to drive the charge-sharing thin film transistor, each scan line array being spaced apart and separated from each other; and the quantity of the first scan lines is equal to that of the second scan lines; and gate drivers on array circuit, each gate driver on array circuit comprising a first driver circuit and a second driver circuit, wherein the first driver circuit and the second driver circuit are arranged in parallel at an interval; the quantity of the first driver circuits is equal to that of the second driver circuits, wherein each of the first driver circuit comprises:

two first sub driver circuits, wherein the two first sub driver circuits are correspondingly connected to one of the first scan line and oppositely arranged on two ends of the first scan line, and the two first sub driver circuits jointly drive the first scan line;

each of the second driver circuit comprises:

two second sub driver circuits, wherein the two second sub driver circuits are correspondingly connected to one of the second scan line and oppositely arranged on two ends of the second scan line, and the two second sub driver circuits jointly drive the second scan line;

the two first sub driver circuits oppositely arranged on the two ends of the first scan line jointly drive the first scan line to be ON or OFF, so as to control the main driver thin film transistor and the sub driver thin film transistor to be turned on or turned off;

the two second sub driver circuits oppositely arranged on the two ends of the second scan line jointly drive the second scan line to be ON or OFF, so as to control the charge-sharing thin film transistor to be turned on or turned off; and when the charge-sharing thin film transistor is turned on, a potential difference is present between the main pixel and the sub pixel of each of the pixel units after the main driver thin film transistor and the sub driver thin film transistor are turned on.

15. The driving apparatus of the display panel of claim 14, wherein the quantity of the first driver circuits is equal to that of the second driver circuits.

16. The driving apparatus of the display panel of claim 14, wherein the two first sub driver circuits jointly drive the first scan line to be ON or OFF, so as to control the main driver thin film transistor and the sub driver thin film transistor to be turned on or turned off.

17. The driving apparatus of the display panel of claim 16, wherein the gate of the main driver thin film transistor and the gate of the sub driver thin film transistor are separately connected to the first scan line; the source of the main driver thin film transistor and the source of the sub driver thin film transistor are charge input ends of the pixel units; and the drain of the main driver thin film transistor is a charge storage end of the main pixel, and the drain of the sub driver thin film transistor is a charge storage end of the sub pixel.

18. The driving apparatus of the display panel of claim 17, wherein the gate of the charge-sharing thin film transistor is connected to the second scan line; the source of the charge-sharing thin film transistor is connected to the charge storage end of the sub pixel; and the drain of the charge-sharing thin film transistor is a shared charge storage end of the sub pixel.

19. The driving apparatus of the display panel of claim 16, wherein the gate of the main driver thin film transistor and the gate of the sub driver thin film transistor are separately connected to the first scan line; the drain of the main driver thin film transistor and the drain of the sub driver thin film transistor are charge input ends of the pixel units; and the source of the main driver thin film transistor is a charge storage end of the main pixel, and the source of the sub driver thin film transistor is a charge storage end of the sub pixel.

20. The driving apparatus of the display panel of claim 19, wherein the gate of the charge-sharing thin film transistor is connected to the second scan line, the drain of the charge-sharing thin film transistor is connected to the charge storage end of the sub pixel, and the source of the charge-sharing thin film transistor is the shared charge storage end of the sub pixel.

* * * * *